US006350361B1

(12) United States Patent
Sexton et al.

(10) Patent No.: US 6,350,361 B1
(45) Date of Patent: Feb. 26, 2002

(54) REAL TIME CONTROL DEVICE FOR ELECTROFORMATION, PLATING AND DEPLATING PROCESSES

(75) Inventors: Richard W. Sexton, Huber Heights; James E. Harrison, Jr., Dayton; Randy L. Fagerquist, Fairborn, all of OH (US)

(73) Assignee: Scitex Digital Printing, Inc., Dayton, OH (US)

( * ) Notice: Subject to any disclaimer, the term of this patent is extended or adjusted under 35 U.S.C. 154(b) by 0 days.

(21) Appl. No.: 09/251,606

(22) Filed: Feb. 17, 1999

(51) Int. Cl.[7] ..... C25D 1/08; C25D 21/12

(52) U.S. Cl. ..... 205/82; 205/67; 205/75; 205/84; 205/641; 216/27; 216/60; 216/85; 427/8; 427/10

(58) Field of Search ..... 205/81, 82, 84, 205/67, 75, 641; 427/10, 8; 216/60, 85, 27; 436/164

(56) References Cited

U.S. PATENT DOCUMENTS 4,939,370 A * 7/1990 Meyer et al. ..... 250/372
5,372,645 A * 12/1994 Fnthony et al. ..... 118/665
5,759,615 A * 6/1998 Lasley et al. ..... 427/9
5,955,139 A * 9/1999 Iturralde ..... 427/9

* cited by examiner

*Primary Examiner*—Kathryn Gorgos
*Assistant Examiner*—William T. Leader
(74) *Attorney, Agent, or Firm*—Barbara Joan Haushalter

(57) ABSTRACT

Precise control of deposition or etching of thin films on a transparent substrate is particularly useful for electroformation of nozzles and formation control. A computer based measuring system is used to measure, in real time, a test feature such as one such nozzle. The rate of material deposition and removal is controlled based on the measured value of the test feature. In particular, a video camera and microscope are used to produce images of the test feature. During the electroplating process, metal is plated onto a conductive layer, and as the plated metal layer grows up from the conductive layer of the mandrel, the plated layer can also encroach on transparent openings produced by the absence of the mandrel conductive layer. The amount of encroachment on the transparent openings is directly related to the thickness of the plated layer.

13 Claims, 3 Drawing Sheets

REAL TIME CONTROL DEVICE FOR ELECTROFORMATION, PLATING AND DEPLATING PROCESSES

TECHNICAL FIELD

The present invention relates to precise control of deposition or etching of thin films on a transparent substrate and, more particularly, to electroformed nozzles and formation control.

BACKGROUND ART

Deposition and etching by either electrochemical or solid state means are relatively slow processes that usually are controlled by establishing the rate of change and then stopping the process at a given time. However, because the processes are slow, often requiring hours or days, the chemistry of reactants can change during the process, such that precise dimensional control (e.g., to fractions of micrometers) becomes very difficult. As a result, the scrap rate for these processes can be unacceptably high.

Certain thin film processes are conducted on transparent substrates such as glass or plastic. Electroforming is one such process that can be performed on conductive glass substrates (mandrels). One field where precise dimensional control can be particularly useful is in the field of continuous ink jet printing. High resolution ink jet printing requires the droplet-forming nozzles in an array to be all essentially the same diameter so that there are no variations in darkness of print, especially for printing graphics. In addition, the uniformity of nozzle diameter is important from printhead-to-printhead so that print darkness and quality is always predictable. Although the existing art uses a means for controlling the uniformity of nozzle diameter in an array to very tight tolerances, day to day variations in electroforming bath chemistry can affect the efficiency of metal deposition so that plating to a set time does not always produce the same thickness of plating (i.e., the diameter can vary).

It is seen then that there exists a need for a means for precise dimensional control of dimensions produced by deposition or etching processes.

SUMMARY OF THE INVENTION

In accordance with the present invention, a real time control device for electroformation of precise diameter nozzles is proposed, by microscopically measuring the orifice through a transparent substrate with video image analysis. The present invention utilizes the horizontal plating arrangement, a transparent plating mandrel, and video measurement techniques to provide real time control of electroforming to make nozzles having diameter variations of less than one micrometer.

In accordance with one aspect of the present invention a method has been developed to accurately measure the growth of a deposit during the deposition on one side of a transparent substrate. The present invention utilizes the special attributes of the plating cell arrangements for precise control of the orifice diameter as it is being formed. In particular, precise control of deposition or etching of thin films on a transparent substrate is achieved using a computer based measuring system to measure, in real time, a test feature whose measured dimensions are representative of the dimensions of the desired features of the object being processed. The rate of material deposition and removal is controlled based on the measured value of the test feature. In particular, a video camera and microscope are used to produce images of the test feature.

Other objects and advantages of the invention will be apparent from the following description and the appended claims.

DETAILED DESCRIPTION OF THE INVENTION

Horizontal electrode cell arrangements are particularly well suited for electroforming long array orifice plates. Orifice plates for ink jet printers are electroformed by plating nickel in a cell designed to provide very low thickness variation, typically less than 30 micro inches, over large areas, in order to minimize orifice diameter variance. The present invention is facilitated by the horizontal electroforming cell designed and evaluated for nickel plating on large area substrates, the substrates having photolithographic patterns thereon. The horizontal electroforming cell is used to uniformly nickel plate over suitable dielectric portions , such as by using the photoresist pegs described in U.S. Pat. No. 4,184,925, totally incorporated herein by reference, on the large area substrate.

Figure 1:
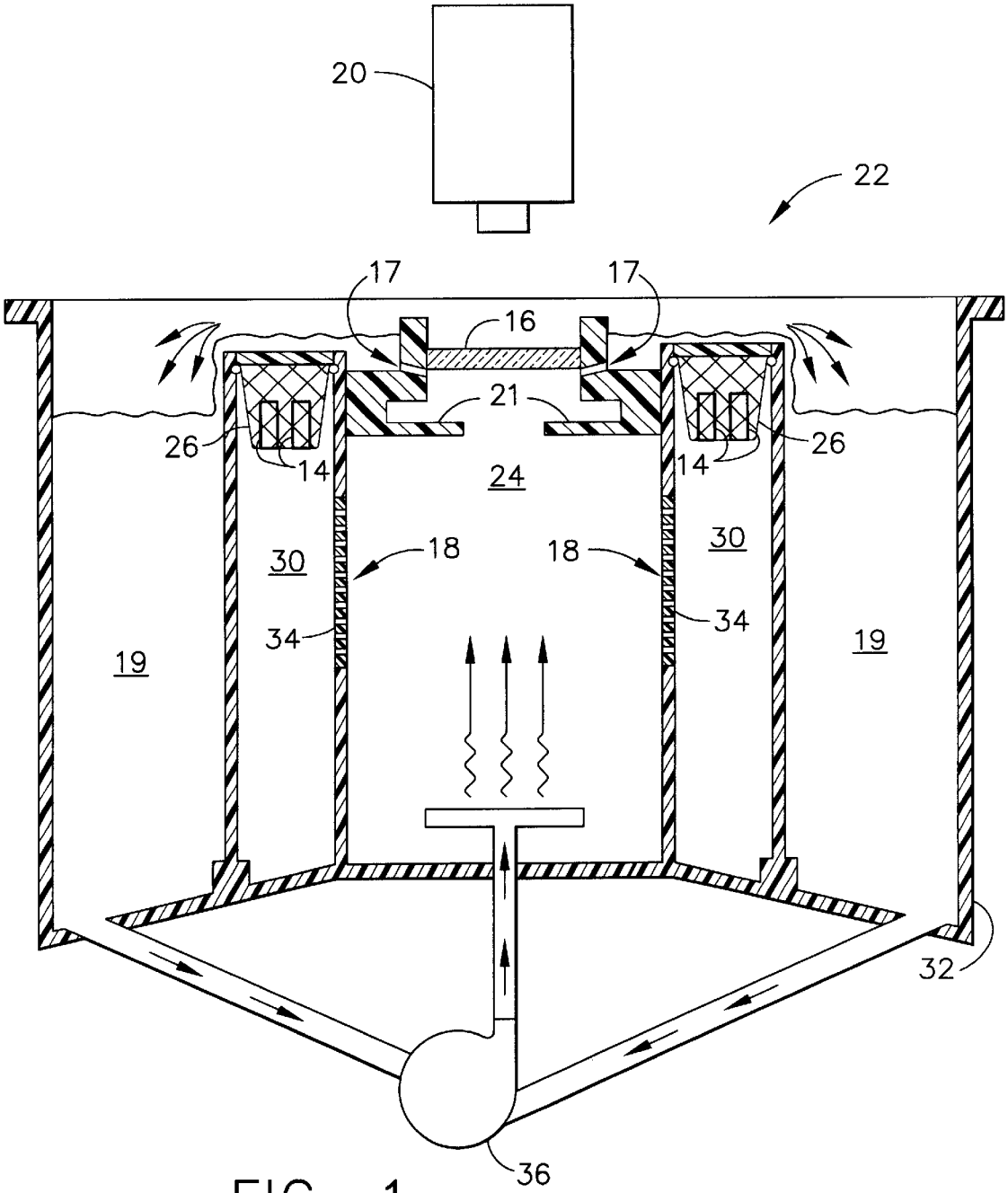
FIG. 1 shows a horizontal plating arrangement with a video microscope.

Referring now to FIG. 1, a horizontal plating arrangement for a large area electroforming cell 22, with a video microscope camera 20, is shown. Advantages of the cell shown in FIG. 1 will be apparent to those skilled in the art of electroplating for engineering applications. Firstly, in order to provide smooth, defect-free deposits, freshly filtered electrolyte is forced into cathode compartment 24 and flows upward toward the cathode 16, where the electroforming takes place; and then the solution flows outwardly through ports 17 and back to sump compartments 19 for recirculation through the filter. This design ensures that the cathode compartment 24 has slightly positive pressure so that only freshly filtered solution is present with no stagnant areas where particles can collect. The plating solution flows upward across the cathode surface and over a weir 26 supporting the anode 14, and then back to circulation pump 36 for refiltration. The cathode 16 is framed with appropriate plastic shields 21 to further enhance deposit uniformity.

A unique aspect of this design involves placement of the soluble anodes 14 in their own compartment 30, adjacent to the cathode 16, and enclosed within tank 32. Two anodes are used to provide symmetry for current distribution. In conventional plating tanks, long, heavy, nickel anodes are suspended from rods along the side of the tank, parallel to the vertically suspended cathode. During dissolution of the anode, which occurs in the normal course of plating, fine particle sludge is produced consisting of metal fines and insoluble nickel compounds and carbon. Common practice is to place the anodes inside a woven textile bag (i.e., anode bag) made of fibers that are inert to the plating solution. The weave of the bag is kept as tight as possible, however when anodes are removed for servicing, fine anode sludge seeps through the bag into the working solution. Free particles are especially harmful in electroforming fine structures such as orifice plates, because they are codeposited with the nickel and result in defects that render the orifice plate useless. This problem is overcome by placing the anodes in the separate compartments 30 so that particles are gravitationally isolated from the cathode.

Continuing with FIG. 1, the cathode and anode are placed in isolated compartments interconnected by a current-path window 18 covered with a fine porous screen 34. Particles generated at the anode 14 cannot enter the cathode compartment 24 because of slight positive pressure therein. Particles tend to settle to the sloped bottom of the plating tank 32 and can be drained off from the sump through filter pump 36 without disturbing the plating operation or contaminating the bulk of the plating solution.

The horizontal plating cell provides excellent deposit uniformity for making orifice plates, and takes advantage of electrode compartmentalization to utilize gravity for segregation of harmful particles that are prevalent in cells using soluble anodes. The horizontal electrode cell arrangement provides a clean system for plating and electroforming in which the anodes and cathodes are readily removable. The anodes are located remotely from the cathode, so that shed particles such as carbon, nickel, and sulfide residues, will not deposit onto the electroform. The arrangement further provides modularity in that the panels can be as long as required without modifying the basic components. The current distribution will be the same for each additional length segment, so that as the requirement for longer printing bars occurs, only the length of the tank needs adjustment.

The horizontal cell arrangement allows the back side of the plating mandrel to be at the surface of the plating bath. When used with a transparent or partial transparent plating mandrel, this allows the growth of the plated layer to be observed during the plating operation. In conventional plating applications, that is without the horizontal plating cell and the transparent mandrel, observing the growth of the plated layer is made extremely difficult due to the high turbidity of the plating solutions.

One method for making such a transparent mandrel comprises the steps of sputter depositing a 2000 Å to 5000 Å thick layer of Titanium-Tungsten, molybdenum, or, copper (i.e., metallization layer 40) on a glass or other transparent non-conductive substrate 44. A first photoresist layer is then deposited on the metallization layer in a spin coater, i.e., using a spin coating process, and the photoresist layer is cured. The photoresist layer is exposed to actinic radiation and then developed to produce a photomask pattern on the photoresist layer. The next step is to plasma etch the metallization layer 40 with a Halogen containing gas to form an etched conducting film mold. The conductive metal layer is removed by this process in areas not masked by the photoresist. The photoresist is removed. This mandrel is highly reflective due to the conductive metallization layer. Where the metallization has been removed, transparent openings are produced in the mandrel. A new photoresist layer 45 is applied and processed to produce photoresist pegs which are aligned over the openings etched in the metallization layer. The remaining photoresist layer is stripped to complete construction of the mandrel. The photoresist pegs which are aligned over the openings etched in the metallization layer are transparent so the resulting mandrel has transparent openings 43, as shown in FIG. 2B.

Accurately measuring and controlling the deposition or removal of a material includes providing a suitable means for such material deposition and removal, and controlling the rate of such deposition and removal. One such suitable means for material deposition or removal is an electrochemical process. Another suitable means is an electroforming cell. The horizontal plating cell provides excellent deposit uniformity for making orifice plates, and takes advantage of electrode compartmentalization to utilize gravity for segregation of harmful particles that are prevalent in cells using soluble anodes.

Figure 3A:
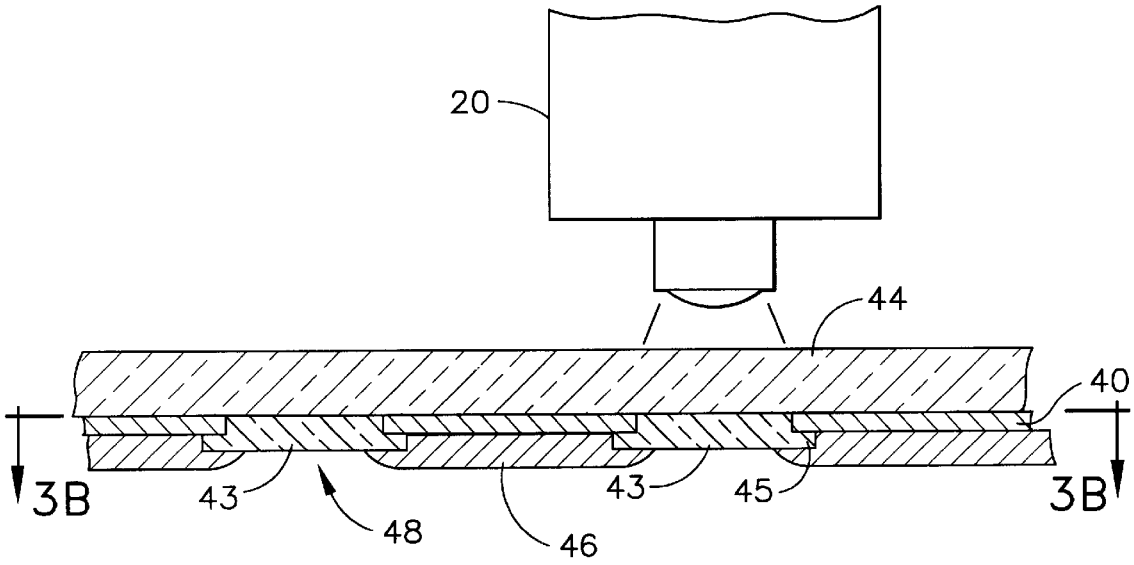
FIG. 3A is a same view as FIG. 2A, but metal has been electrodeposited on to the mandrel.

During the electroplating process, Nickel 46 is then electrodeposited onto the conductive metallization 40 and overgrows the photoresist 45. As the plated metal layer grows up from the conductive layer of the mandrel, it can grow up over the photoresist pegs 45. The plated layer can then build up laterally over the surface of the photoresist pegs as shown in FIG. 3A. This lateral build up of the plated layer encroaches on the transparent openings produced by the absence of the mandrel conductive layer. The amount of encroachment onto the transparent openings is directly related to the thickness of the plated layer. In orifice plates made for ink-jet printers by this process, the diameter of the orifices is determined by the amount of encroachment of the plating into the transparent openings of the mandrel.

Figure 3B:
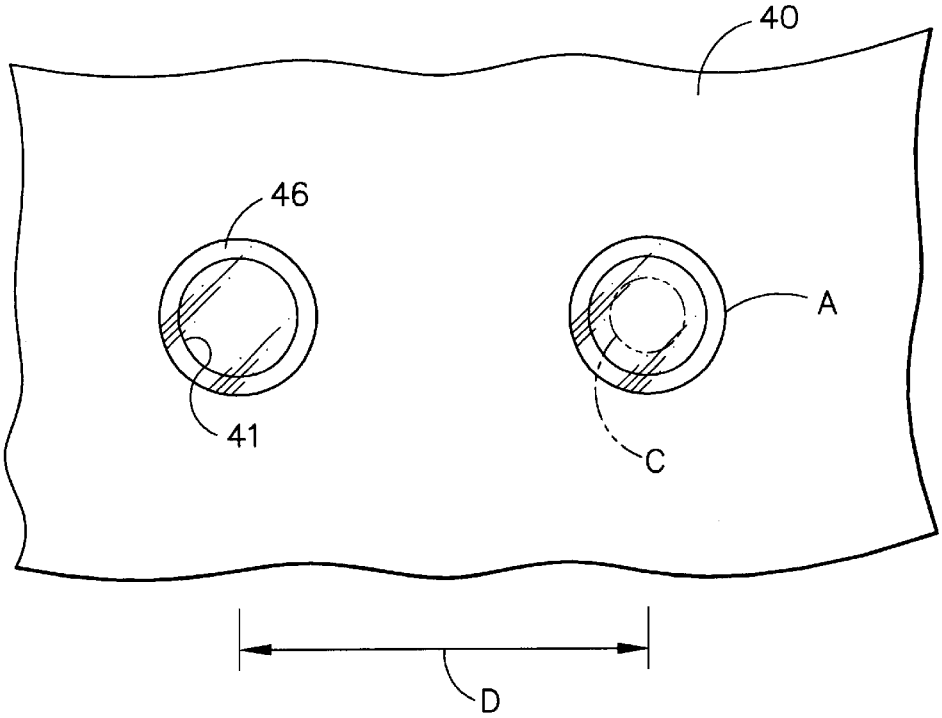
FIG. 3B is a top view of the mandrel, showing encroachment of metal into a transparent opening.

Referring to FIG. 3B, this metal layer which encroaches on the transparent openings is highly reflective. When the plating process is observed through the transparent openings, the size of the opening appears to change due to the encroachment of the plated layer on the transparent openings of the mandrel.

Figure 2A:
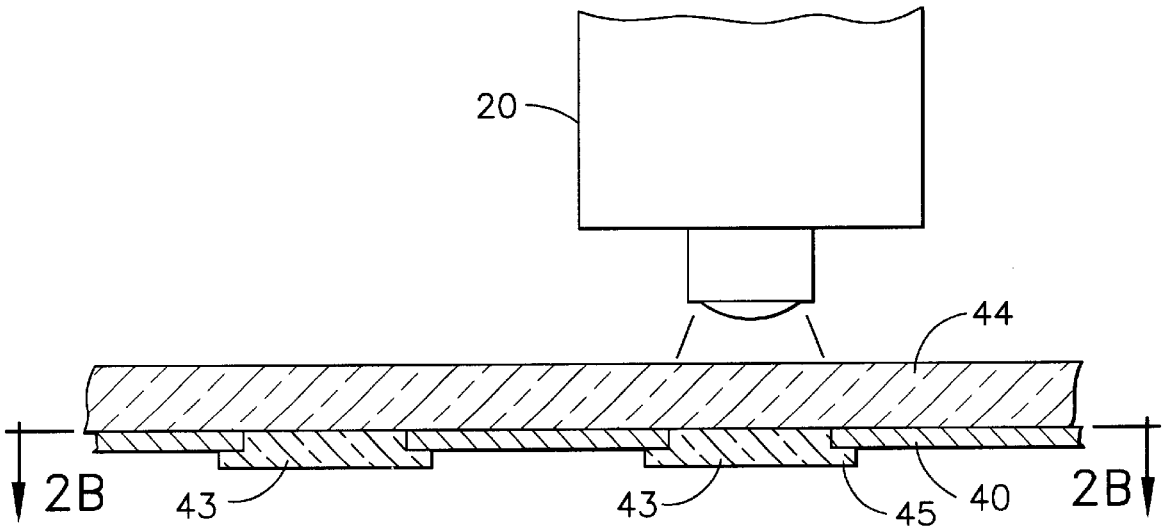
FIG. 2A show a cut away side view of the mandrel having transparent openings, with measuring means located to measure the diameter of a transparent opening.
Figure 2B:
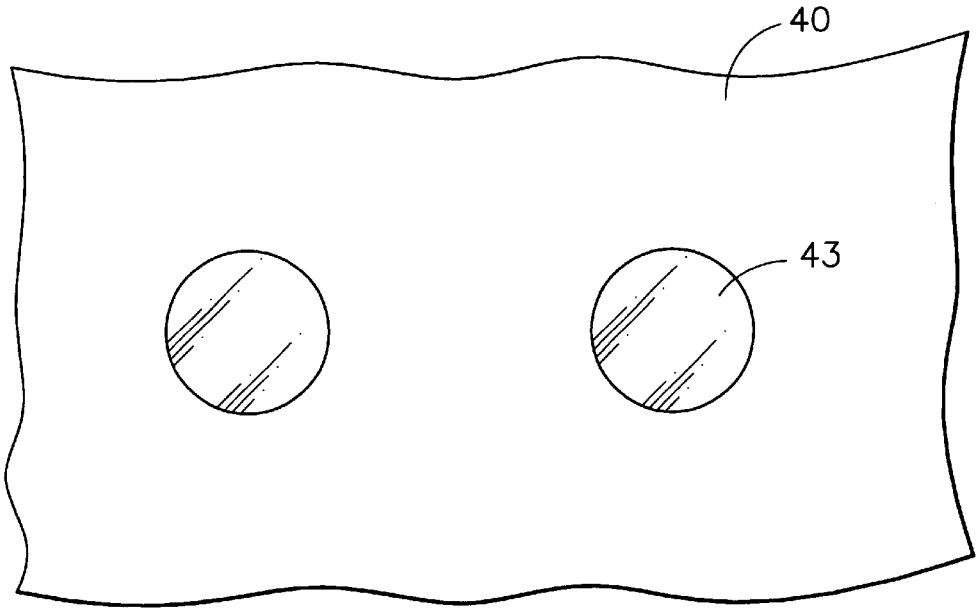
FIG. 2B is a top view of the mandrel, showing the two such transparent openings in the mandrel.

Plating in the horizontal cell presents the back side of the mandrel to the space above the plating solution 50, as shown in FIG. 2A. A clean dry area of the backside of the mandrel can be provided by damming around the perimeter of the mandrel to exclude the plating solution. A microscope with a video camera placed above the plating mandrel collects an image of the mandrel and sends the image to a frame grabber board in a computer, where the image can be processed by an imaging measuring program. One such commercially available program is Image Pro by Media Cybernetics, which uses edge detection means to identify the plated orifice, which it then measures. By obtaining and processing images of the plated layer through a transparent opening 10 times per minute, the diameter of the plated orifice can be measured essentially at real time. The size of the transparent opening in the mandrel can be seen to decrease from the initial diameter of 'A' as the electroformed nickel encroaches into the opening as shown in FIG. 3B. At the exact time when the diameter reaches the desired precise value 'C', the computer program automatically sends a shut off signal to the plating power supply, stopping further plating. In this way it is possible to create an electroformed orifice 48 with a diameter of precisely known value.

This real time monitoring system not only provides a means to halt the electroplating process when the desired measured size is achieved, but can also be used to monitor the growth rate of the plating. In many plating systems, the stress on the plated layer is a function of the growth rate. The growth rate information provided by the present invention, coupled with knowledge of the plating bath, can therefore be used to regulate the plating stress by changing the supplied current level to the part and thereby change the growth rate. This may be particularly useful in those plating baths which can produce zero stress plating at certain growth rates. No longer would it be needed to estimate the growth rate from the current density.

Another attribute of the image measuring system of the present invention is that it can be self calibrating. For arrays of nozzles or orifices, the spacing between nozzles is always precisely controlled whether it be 120, 240, or 300 nozzles per inch or any other known spacing. For the present invention, this known value of spacing can be written into the measurement program so that as each video sample is taken, the known internozzle distance is sampled and used to calibrate the diameter measurements. Therefore, the effects of magnification and focusing on the diameter measurement can be minimized. Using the present invention, it has been found that variation in the orifice diameter from run to run could be held to less than 1 micron.

The present invention, therefore, allows for a system for controlling orifice size in an ink jet printer. A test feature is provided, having a size that can be monitored in real time by a computer based measuring system. The test feature can have a transparent region, and the computer based measuring system can include a camera system to produce images of the test feature. Material deposition and removal on a substrate is controlled, wherein the deposition and removal of material occurs on a side of the substrate opposite the computer based measuring system for measurement of the test feature. Deposit growth at a location of encroachment of deposit into the transparent region of the test feature is also measurable.

In addition, the control of material deposition and removal on the substrate can be accomplished using an electroforming cell. The electroforming cell preferably has a bottom face of a horizontally positioned mandrel as the cathode, to prevent dirt from gravitationally settling onto the plated surface. Furthermore, the electroforming cell is capable of providing substantially uniform plating onto the cathode. The substantially uniform plating onto the cathode is achieved with at least one anode which extends substantially the length of the cathode, or with a pair of anodes which are substantially symmetrically located on either side of the long axis of the cathode. The cathode can be isolated from debris formed at the anode(s) by placing the anode(s) in a compartment separate from the cathode.

A plating solution can then be allowed to flow from the cathode compartment through at least one current-path window into the anode compartment(s). The cathode and anode compartments can be hydraulically and electrically connected by an opening covered with a filter screen. Insulating shields located in an associated relationship with the cathode can be used to determine optimum plating uniformity.

While the present invention discloses utilizing a video system and image analysis software to measure the plated diameter, other probes and methods can be used while staying within the spirit of the invention. For example, digital still cameras could be used instead of the video camera with the frame grabber. Alternatively, a light source could illuminate a test feature. The amount of light reflected off the test feature or transmitted through the transparent opening of the test feature could provide a measure of the size of the test feature.

The features to be measured need not be restricted to circles. The amount of encroachment onto slots or any other shaped transparent opening could also be monitored real time.

Furthermore, the present invention is not limited to use with horizontal plating cells. In other plating tanks, fiber optics probes may be used to illuminate and obtain the image of the test features even if the test features are immersed in the plating solution.

While the description above describes the real time control of electroplating, where a deposit is grown on a substrate, it must be recognized that the process of the present invention can used in any plating, electroforming, or de-plating process, as well as other film or crystal growth or removal processes, where the growth or removal might be monitored real-time by an edge detection video system of some other probe. As with electroplating, a material growth process, real time control of deplating or etching requires a computer based measuring system, a feature whose size can be measured real time by the measuring system, and means to stop the material removal process when a desired dimension is achieved.

The present invention relates especially to electroforming performed on one side of a transparent substrate 44 (e.g., glass sheet) in which the change is the advancing edge of deposit growth can be viewed through the side of the substrate opposite the side where the deposition is occurring. The invention typically involves measuring very accurately a changing diameter or line width to get the instantaneous rate of change so that the process can be halted at the exact desired dimension.

The invention has been described in detail with particular reference to certain preferred embodiments thereof, but it will be understood that modifications and variations can be effected within the spirit and scope of the invention.

What is claimed is:

1. A method for accurately measuring and controlling the deposition or removal of a material comprising the steps of:

providing a computer based optical measuring system;

providing a test feature having a size that can be measured in real time by the optical measuring system;

providing means for material deposition and removal at a deposition and removal rate, and providing material deposition on a mandrel, the mandrel being transparent at the test feature; and affecting the rate of material deposition or removal in response to measurements of the test feature made by the optical measuring system.

2. A method as claimed in claim 1 wherein the step of affecting the rate of material deposition or removal comprises the step of stopping deposition or removal when a desired measurement value of the test feature is achieved.

3. A method as claimed in claim 1 wherein the step of affecting the rate of deposition or removal comprises the step of maintaining a desired rate of change of the measured value of the test feature.

4. A method as claimed in claim 1 wherein the step of providing a computer based optical measuring system further comprises the step of using a camera system to produce a digital image of the test feature.

5. A method as claimed in claim 4 wherein the computer based optical measuring system comprises edge detection means to make measurement of the test feature from the digital image.

6. A method as claimed in claim 1 wherein the step of providing a computer based optical measuring system comprises the step of providing means to measure amount of light reflected by or transmitted through the test feature to provide a measure of size of the test feature.

7. A method as claimed in claim 1 wherein the step of providing a test feature further comprises the step of providing a circular test feature.

8. A method as claimed in claim 1 wherein the step of providing a test feature further comprises the step of providing a test feature having a transparent region.

9. A method as claimed in claim 8 further comprising the step of measuring growth of the material deposition into the transparent region of the test feature.

10. A method as claimed in claim 1 wherein the step of providing a test feature further comprises the step of optically measuring the test feature from a side of the mandrel opposite the material deposition.

11. A method as claimed in claim 1 further comprising the step of providing material deposition on a mandrel comprises the step of limiting the material deposition to a bottom surface of the mandrel.

12. A method as claimed in claim 1 further comprising the step of applying a conductive layer in regions to electroplate.

13. A method as claimed in claim 1 wherein the step of providing means for material deposition and removal further comprises the step of using an electrochemical process for deposition and removal of material.

* * * * *